US006356233B1

(12) United States Patent
Miller et al.

(10) Patent No.: US 6,356,233 B1
(45) Date of Patent: Mar. 12, 2002

(54) STRUCTURE FOR AN ARRAY ANTENNA, AND CALIBRATION METHOD THEREFOR

(75) Inventors: Richard Earl Miller, Mt. Laurel, NJ (US); Robert Michael Reese, Philadelphia, PA (US)

(73) Assignee: Lockheed Martin Corporation, Moorestown, NJ (US)

( * ) Notice: Subject to any disclaimer, the term of this patent is extended or adjusted under 35 U.S.C. 154(b) by 0 days.

(21) Appl. No.: 09/734,868

(22) Filed: Dec. 12, 2000

(51) Int. Cl.[7] ..... H01Q 3/22
(52) U.S. Cl. ..... 342/368; 342/174
(58) Field of Search ..... 342/165, 174, 342/368, 372

(56) References Cited

U.S. PATENT DOCUMENTS

| | | | | |
|---|---|---|---|---|
| 5,063,529 | A | 11/1991 | Chapoton | 364/571.02 |
| 5,248,982 | A | 9/1993 | Reinhardt et al. | 342/375 |
| 5,412,414 | A | 5/1995 | Ast et al. | 342/174 |
| 5,459,474 | A | 10/1995 | Mattioli et al. | 343/702 |
| 5,572,219 | A | 11/1996 | Silverstein et al. | 342/375 |
| 6,084,545 | A | 7/2000 | Lier et al. | 342/360 |

OTHER PUBLICATIONS

H. Aumann, A. Fenn and F. Willwerth, "Phased Array Antenna Calibration and Pattern Prediction Using Mutual Coupling Measurements", IEEE Trans. on Antennas and Propagation, vol. 37, No. 7, Jul. 1989, pp. 844–850.

*Primary Examiner*—Dao Phan
(74) *Attorney, Agent, or Firm*—W. H. Meise; S. D. Weinstein

(57) ABSTRACT

An array of antenna elements is arranged to calibration by assigning certain ones of the elements to be "kernel" elements. The kernel elements are coupled to the beamformer by way of a directional coupler arrangement, and calibration ports are coupled to ports of the directional coupler. Calibration includes applying signal to a first calibration port of a kernel element and determining the amplitude andor phase of the calibration signal paths. Signals are applied to the beamformer ports feeding the kernel element, and the lengths of the beamformer-plus-calibration paths are determined. From these, the beamformer paths to the kernel elements are determined. Other non-kernel antenna elements near the kernel elements are calibrated by applying signal through the beamformer to the non-kernel element, and receiving the signal through a calibration path of the kernel element.

4 Claims, 3 Drawing Sheets

STRUCTURE FOR AN ARRAY ANTENNA, AND CALIBRATION METHOD THEREFOR

FIELD OF THE INVENTION

This invention relates to array antennas, and more particularly to array antenna structures to aid in calibration of the active elements of the array.

BACKGROUND OF THE INVENTION

Our society has become dependent upon electromagnetic communications and sensing. The communications are exemplified by radio, television and personal communication devices such as cellphones, and the sensing by radar and lidar. When communications were in their infancy, it was sufficient to broadcast radio signals substantially omnidirectionally in the horizontal plane, and for that purpose a vertical radiator or tower was satisfactory. Early sensors attempted to produce directional results, as for example the directional null used for direction-finding in the Adcock type of antenna. When it became possible to produce short-wave signals such as microwave signals efficiently and relatively inexpensively, directional results became possible with shaped reflector antennas, which provided the relatively large radiating aperture required for high gain and directionality. Such antennas have been in use for over half a century, and they continue to find use because they are relatively simple to build and maintain. However, the shaped-reflector antenna has the salient disadvantage that it must be physically moved in order to move the antenna radiated beam or beams.

Those skilled in the art know that antennas are reciprocal elements, which transduce electrical or electromagnetic signals between unguided (radiating-mode) and guided modes. The "unguided" mode of propagation is that which occurs when the electromagnetic radiation propagates in "free space" without constraints, and the term "free space" also includes those conditions in which stray or unwanted environmental structures disturb or perturb the propagation. The "guided" mode includes those modes in which the propagation is constrained by transmission-line structures, or structures having an effect like those of a transmission line. The guided-wave mode of propagation occurs in rigid waveguides, and in coaxial cable and other transmission-line structures such as microstrip and stripline. The guided-wave mode also includes transmission guided by dielectric structures and single-wire transmission lines. Since the antenna is a transducer, there is no essential difference between transmission and receiving modes of operation. For historical reasons, certain words are used in the antenna fields in ways which do not reflect contemporaneous understanding of antennas. For example, the term used to describe the directional radiation pattern of an antenna is "beam," which is somewhat meaningful in the context of a transmitting antenna, but which also applies to a receiving antenna, notwithstanding that conceptually there is no corresponding radiation associated with an antenna operated in its receiving mode. Those skilled in the art understand that an antenna "beam" shape is identical in both the transmission and reception modes of operation, with the meaning in the receiving mode being simply the transduction characteristic of the antenna as a function of solid angle. Other characteristics of antennas, such as impedance and mutual coupling, are similarly identical as between transmitting and receiving antennas. Another term associated with antennas which has a contemporaneous meaning different from the apparent meaning is the definition of the guided-wave port, which is often referred to as a "feed" port regardless of whether a transmitting or receiving antenna is referred to.

Array antennas are antennas in which a large radiating aperture is achieved by the use of a plurality of elemental antennas extending over the aperture, with each of the elemental antennas or antenna elements having its elemental port coupled through a "beamformer" to a common port, which can be considered to be the feed port of the array antenna. The beamformer may be as simple as a structure which, in the reception mode, sums together the signals received by each antenna element without introducing any relative phase shift of its own, or which in the transmission mode of operation receives at its common port the signal to be transmitted, and divides it equally among the antenna elements. Those skilled in the art know that the advantages of an array antenna are better realized when the signal transduced by each elemental antenna of an array antenna can be individually controlled in phase. When phase is controlled, it is possible to "steer" the beam of the array antenna over a limited range without physical slewing of the structure. Introduction of phase shifters into the feed path of the elemental antennas, and for that matter the beamformer itself, necessarily introduces unwanted resistive or heating losses or "attenuation" into the signal path. These losses effectively reduce the signal available at a receiver coupled to the array antenna feed port in the reception mode of operation, and also reduce the power reaching the antenna elements from the feed port when in a transmission mode of operation.

In order to maximize the utility of array antennas, it is common to introduce electronic amplifiers into the array antenna system, to aid in overcoming the losses attributable to the beamformer and to the phase shifters, if any, and any associated hardware such as filters and the like. In an array antenna, one such amplifier is used in conjunction with each antenna element. For reception of weak signals, it is common to use an amplifier which is optimized for "low-noise" operation, so as to amplify the signal received by each antenna element without contributing excessively to the noise inherent in the signal received by the antenna element itself. For transmission of signals, a "power" amplifier is ordinarily associated with each antenna element or group of antenna elements, to boost the power of the transmitted signal at a location near the antenna elements. In array antennas used for both transmission and reception, both receive and transmit amplifiers may be used.

Amplifiers tend to be nonlinear, in that the output signal amplitude of an amplifier is in a specific amplitude ratio to the input signal amplitude at input signal levels lying below a given level, but become nonlinear, in that the ratio becomes smaller (the gain decreases to a value below the small-signal level) with increasing signal level. Structures which are subject to such saturation or other nonlinear effects are termed "active." It should be noted that an active element is often defined as one which requires or uses an electrical bias for operation; saturation tends to be inherent in such elements when the signal being handled approaches or equals the amplitude of the applied bias. Amplifiers are ordinarily not bidirectional, in that they amplify signals received at an input port, and the amplified signals are generated at an output port. Although bidirectional amplifiers are possible, the constraints required for bidirectional operation limit their utility, and unidirectional amplifiers are commonly used for array antennas. In the case of an array antenna used for both transmission and reception, each antenna element is associated with both a power amplifier and low-noise amplifier. Bidirectional, duplex or diplex operation, which is to say simultaneous operation in both transmission and reception, is accomplished by the use of circulators, which are three-port devices which allow connection of an antenna element to the output port of a power amplifier and to the input port of a low-noise amplifier. It should be noted that phase shifters which may be associated with each radiating element of an array in order to allow steering of the beam may be subject to saturation or nonlinear effects, and so may be considered to be "active" for this purpose, although these nonlinear effects may not be nearly so pronounced as in the case of amplifiers, and in some cases the saturation effects of phase shifters may be ignored. Some types of phase shifters rely on the interaction of discrete electronic elements, which are affected by temperature and aging. Other types of phase shifters are almost immune to saturation effects, namely those using electronic switches to switch lengths of transmission line into and out of circuit.

One of the problems associated with the use of array antennas having active elements is that of changes in the characteristics of the active elements as a function of environmental conditions and of time. For example, the gain of an amplifier may change as a function of time or temperature, and the gain change can affect the beam formed by the beamformer in both transmission and in reception modes of operation, depending upon its location in the array antenna. Similarly, the inherent phase shift of an amplifier may change as a function of time or temperature, which in turn affects the net phase shift of the signal relating to that particular antenna element with which it is associated, which in turn affects the beam shaping or forming. The effects of aging and temperature on active devices associated with the elemental antennas of an active array antenna result in a requirement for calibration of the various active elements.

A difficult aspect of the calibration of the active elements of an array antenna is the determination of exactly what the characteristics of the active element(s) are, since the active elements tend to be "buried" in the antenna structure. If attempts are made to physically access the input and output ports of the active elements, connections to the active elements must be made and broken for each active element, and the making and breaking of connections may itself introduce errors and changes to the system operation. Also, physical access to the active devices tends to be inconvenient due to the usual locations of the devices near the elemental antennas. U.S. Pat. No. 5,459,474, issued Oct. 17, 1995 in the name of Mattioli et al. describes an array antenna in which each radiating element is associated with one transmit-receive module, and the transmit-receive modules are mounted in racks which can be pulled out to expose the modules. While effective, such rack mountings tend to be relatively bulky, heavy, and expensive. U.S. Pat. No. 5,572,219, issued Nov. 5, 1996 in the name of Silverstein et al. describes a method for calibrating phased-array antennas by the use of a remote site and the transmission of orthogonal codes. U.S. Pat. No. 6,084,545, issued Jul. 4, 2000 in the name of Lier et al. describes a method for calibration of a phased-array antenna which eliminates the need for a distant source, and substitutes a near-field probe. Cooperative distant sources tend to be difficult to obtain at the desired time and location, and the near-field probes necessarily lie before the radiating aperture and perturb the desired fields.

Improved methods for calibration of phased arrays are desired.

SUMMARY OF THE INVENTION

An aspect of the invention lies in a method for calibrating the active elements of an array antenna used for transducing electromagnetic signal between unguided radiation and a guided transmission path. The active array antenna includes a beamformer including at least one guided-wave common port and at least N output ports associated with the common port. The guided-wave common port may be considered to be the "feed" port for one beam of the array antenna. The antenna also includes a beamformer control computer coupled to the beamformer, for transducing signals therewith, and for forming beams based upon at least one of beamformer amplitude and phase transfer functions, and preferably both. The array antenna also includes a plurality of N radiating elements arranged in an array. Each of the radiating elements is capable of transducing electromagnetic signals with its own elemental port. A plurality of 2P calibration ports is provided, where P may be less than N in a preferred embodiment. P directional couplers are provided. Each of the P directional couplers includes first, second, third, and fourth ports, for coupling signal from the first port to the second and third ports and not to the fourth port, and from the second port to the first and fourth ports, but not to the third port. Each of the P directional couplers has its first port coupled to one, and only one, of the calibration ports, its second port coupled to another one, and only that one, of the calibration ports, its third port connected to a "kernel" one, and only that kernel one, of the N radiating elements, and its fourth port coupled to one, and only one, of the N output ports of the beamformer. As a result of these connections of P directional couplers to 2P calibration ports and P output ports out of N available output ports of the beamformer, N−P=R non-kernel ones of the radiating elements lack a guided path to a directional coupler, and R ports of the beamformer are not connected to one of the directional couplers. The array antenna further includes a guided-wave connection between each of the R ports of the beamformer which are not connected to one of the directional couplers and a corresponding one of the R non-kernel radiating elements, as a result of which all of the N elemental antennas are connected to an output port of the beamformer, either through a directional coupler or through another guided-wave connection. At least one of (a) an active amplifier and (b) a controllable phase shifter is associated with at least some of the paths defined between the guided-wave common port and the at least N output ports associated with the common port of the beamformer.

According to another aspect of the invention, a method for calibrating the array antenna includes the step of applying a directional coupler calibration signal to a first one of the calibration ports, for thereby transmitting signal to a first port of a first one of the directional couplers, and in response to the step of applying of a directional coupler calibration signal, receiving returned directional coupler calibration signal at a calibration port coupled to the second port of the first one of the directional couplers. The amplitude and the phase of the returned directional coupler calibration signal are compared with the corresponding amplitude and phase of the calibration signal to establish a calibration transfer value for the guided-wave connection between the first one of the directional couplers and its associated calibration ports. The calibration transfer value may be compared with a predetermined or previously stored value, to thereby establish a directional coupler calibration reference value for the first one of the directional couplers. The next step in the calibration is to (a) apply beamformer calibration signal to the common port of the beamformer and extract corresponding beamformer calibration signal from that calibration port coupled to the second port of the first one of the directional couplers, or (b) apply beamformer calibration signal to that one of the calibration ports coupled to the second port of the first one of the directional couplers, and extract corresponding beamformer calibration signal from the beamformer common port, to thereby determine at least one of the amplitude and phase transfer between the common port of the beamformer and the fourth port of the first one of the directional couplers. As set forth in the claims, the terminology "one of A and B" is slightly different from "either A or B" but has the same meaning, as understood by persons skilled in the art. From the calibration transfer value and from at least one of the amplitude and phase transfer between the common port of the beamformer and the fourth port of the first one of the directional couplers, at least one of the amplitude and phase characteristics of that signal path extending from the common port of the beamformer to the fourth port of the first one of the directional couplers are determined. The beamsteering control computer is adjusted by updating the parameters by which the control takes place, which may mean updating the value of the one of the amplitude and phase characteristic (or both) of that signal path extending from the common port of the beamformer to the fourth port of the first one of the directional couplers.

In a specific embodiment of an array antenna according to an aspect of the invention, the transmission-line electrical lengths extending between the calibration ports and the first and second ports of any one of the directional couplers are made or set equal, whereby the calibration transfer value for each of the cables is equal to one-half the calibration transfer value of the guided-wave connection to the one of the directional couplers.

A specific mode of the method according to the invention includes the further step of de-energizing all active elements of the beamformer except for those active elements lying in that path through the beamformer extending from the common port of the beamformer to a particular non-kernel one of the radiating elements of the array. This specific mode also includes the step of one of (a) applying beamformer calibration signal to the common port of the beamformer and extracting corresponding beamformer calibration signal from that one of the calibration ports associated with the first port of the first one of the directional couplers and (b) applying beamformer calibration signal to that one of the calibration ports associated with the first port of the first one of the directional couplers and extracting corresponding beamformer calibration signal from the common port of the beamformer, to thereby produce a nonkernel calibration signal including a measure of the mutual coupling between that one of the kernel radiating elements associated with the first one of the directional couplers and the particular non-kernel one of the radiating elements of the array. Finally, this specific mode includes the step of adjusting the beamsteering control computer by updating the parameters by which the control takes place by a factor responsive to the nonkernel calibration signal.

DESCRIPTION OF THE INVENTION

Figure 1:
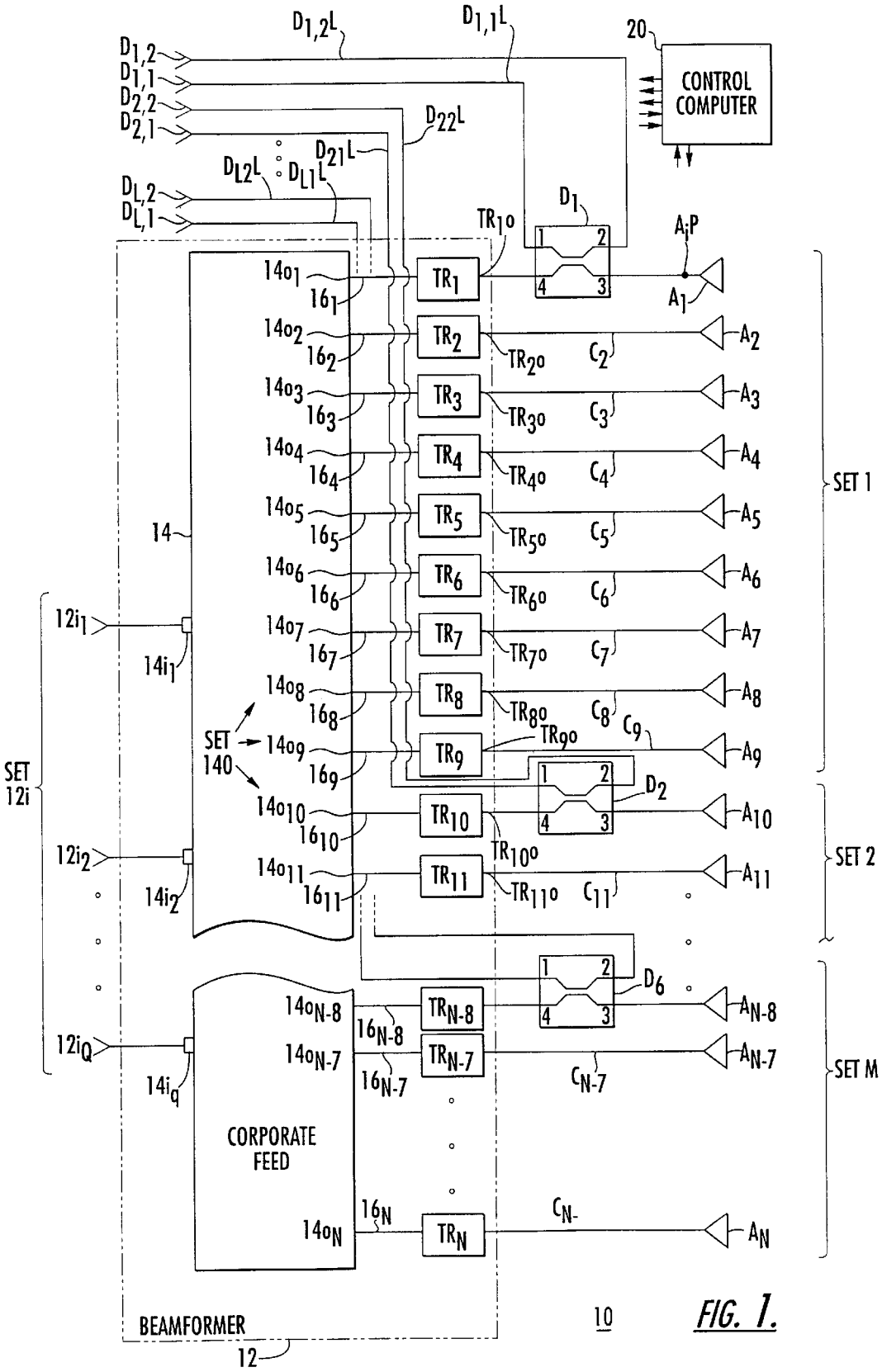
FIG. 1 is a simplified diagram illustrating an active array antenna according to an aspect of the invention.

In FIG. 1, an active array antenna 10 includes a beamformer 12 having a plurality of beam feed or input ports $\mathbf{12}i_1$, $\mathbf{12}i_2, \ldots, \mathbf{12}i_Q$, each of which is coupled to a corresponding "input" or feed port $\mathbf{14}i_1, \mathbf{14}i_2, \ldots, \mathbf{14}i_Q$ of a corporate feed 14. As known to those skilled in the art, signals applied to any one of ports $\mathbf{12}i_1, \mathbf{12}i_2, \ldots, \mathbf{12}i_Q$ produces a single antenna beam, and thus the ports may be termed "beam" ports. The arrangement of FIG. 1 also includes a plurality of elemental antenna ports $\mathbf{14}o_1, \mathbf{14}o_2, \mathbf{14}o_3, \mathbf{14}o_4, \mathbf{14}o_5, \mathbf{14}o_6, \mathbf{14}o_7, \mathbf{14}o_8, \mathbf{14}o_9, \mathbf{14}o_{10}, \mathbf{14}o_{11}, \ldots, \mathbf{14}o_{N-8}, \mathbf{14}o_{N-7}, \ldots, \mathbf{14}o_N$. Each elemental antenna or "output" port of corporate feed 14 is connected by a transmission-line or guided-wave path to a corresponding transmit-receive (TR) module. More specifically, elemental output port $\mathbf{14}o_1$ is connected by a transmission or guided-wave path $\mathbf{16}_1$ to TR module $TR_1$, elemental output port $\mathbf{14}o_2$ is similarly connected to TR module $TR_2$ by a transmission path $\mathbf{16}_2$, elemental output port $\mathbf{14}o_3$ is connected to TR module $TR_3$ by a transmission path $\mathbf{16}_3$, elemental output port $\mathbf{14}o_4$ is connected to a TR module $TR_4$ by a transmission path $\mathbf{16}_4$, elemental output port $\mathbf{14}o_5$ is connected to a TR module $TR_5$ by a transmission path $\mathbf{16}_5$, elemental output port $\mathbf{14}o_6$ is connected to a TR module $TR_6$ by a transmission path $\mathbf{16}_6$, elemental output port $\mathbf{14}o_7$ is connected to a TR module $TR_7$ by a transmission path $\mathbf{16}_7$, elemental output port $\mathbf{14}o_8$ is connected to a TR module $TR_8$ by a transmission path $\mathbf{16}_8$, elemental output port $\mathbf{14}o_9$ is connected to a TR module $TR_9$ by a transmission path $\mathbf{16}_9$, elemental output port $\mathbf{14}o_{10}$ is connected to a TR module $TR_{10}$ by a transmission path $\mathbf{16}_{10}$, elemental output port $\mathbf{14}o_{11}$ is connected to a TR module $TR_{11}$ by a transmission path $\mathbf{16}_{11}, \ldots$, elemental output port $\mathbf{14}o_{N-8}$ is connected to a TR module $TR_{N-8}$ by a transmission path $\mathbf{16}_{N-8}$, elemental output port $\mathbf{14}o_{N-7}$ is connected to a TR module $TR_{N-7}$ by a transmission path $\mathbf{16}_{N-7}, \ldots$, and elemental output port $\mathbf{14}o_N$ is connected to a TR module $TR_N$ by a transmission line $\mathbf{16}_N$.

It should be noted that the terms used in descriptions of electrical systems and devices may not have the same connotations as the corresponding words used in ordinary parlance. Some of the terms associated with antennas are mentioned above. In addition, those skilled in the electrical arts know that a "module" may refer to a particular function, whether or not the functional module is physically modular or not; it is the function, rather than the physical device, which is modular, as conceptualized in system diagrams such as that of FIG. 1.

In FIG. 1, an "output" port of each TR module is connected, either directly by a transmission or coupling path, or indirectly by way of a directional coupler, to a corresponding one of the elemental radiators. More particularly, the output port $TR_1o$ of TR module $TR_1$ is connected by way of a directional coupler $D_1$ to an elemental port $A_1p$ of an elemental antenna $A_1$, the output port $TR_2o$ of TR module $TR_2$ is connected by way of a transmission-line or coupling path $C_2$ to an elemental antenna $A_2$, the output port $TR_3o$ of TR module $TR_3$ is connected by way of a transmission-line or coupling path $C_3$ to an elemental antenna $A_3$, the output port $TR_4o$ of TR module $TR_4$ is connected by way of a transmission-line or coupling path $C_4$ to an elemental antenna $A_4$, the output port $TR_5o$ of TR module $TR_5$ is connected by way of a transmission-line or coupling path $C_5$ to an elemental antenna $A_5$, the output port $TR_6o$ of TR module $TR_6$ is connected by way of a transmission-line or coupling path $C_6$ to an elemental antenna $A_6$, the output port $TR_7o$ of TR module $TR_7$ is connected by way of a transmission-line or coupling path $C_7$ to an elemental antenna $A_7$, the output port $TR_8o$ of TR module $TR_8$, is connected by way of a transmission-line or coupling path $C_8$ to an elemental antenna $A_8$, and the output port $TR_9o$ of TR module $TR_9$ is connected by way of a transmission-line or coupling path $C_9$ to an elemental antenna $A_9$. The output port $TR_{10}o$ of TR module $TR_{10}$ is connected by way of a directional coupler $D_2$ to an elemental antenna $A_{10}$, the output port $TR_{11}o$ of TR module $TR_{11}$ is connected by way of transmission-line or coupling path $C_{11}$ to an elemental antenna $A_{11}$. In addition, in FIG. 1, the output port $TR_{N-8}$ of TR module $TR_{N-8}$ is connected by way of a directional coupler $D_L$ to an elemental antenna $A_{N-8}$, the output port $TR_{N-7}o$ of TR module $TR_{N-7}$ is connected by way of a transmission-line or coupling path $C_{N-7}$ to an elemental antenna $A_{N-7}$, . . . , and the output port $TR_No$ of TR module $TR_N$ is connected by way of a transmission-line or coupling path $C_N$ to an elemental antenna $A_N$.

In the arrangement of FIG. 1, the elemental antennas $A_1, \ldots, A_N$ are grouped into sets of nine. The number nine is selected as exemplary, and other numbers of elemental antennas could be used in each set. Within each set of nine elemental antennas, one antenna, illustrated as being the first elemental antenna of each set, is deemed to be a "kernel" elemental antenna, and is associated with a directional coupler. For example, in set 1 of nine elemental antennas $A_1$ through $A_9$, elemental antenna $A_1$ is illustrated as being connected to port 3 of directional coupler $D_1$. Similarly, in set 2 of nine elemental antennas beginning with elemental antenna $A_{10}$ and including elemental antenna $A_{11}$ (not all elemental antennas of set 2 are shown), elemental antenna is $A_{11}$ is illustrated as being connected to port 3 of directional coupler $D_2$. In FIG. 1, the last set M of nine elemental antennas includes elemental antennas $A_{N-8}, A_{N-7}, \ldots, A_N$. The first elemental antenna of set M, namely elemental antenna $A_{N-8}$, is connected to port 3 of the last directional coupler $D_L$. Thus, for each nine elemental antennas, there is one directional coupler in the system, so the number N of elemental antennas must be nine times L. For purposes of this invention, those elemental antennas associated with directional couplers are designated as "kernel" elemental antennas. Thus, for each kernel elemental antenna, there are eight non-kernel elemental antennas.

Figure 2:
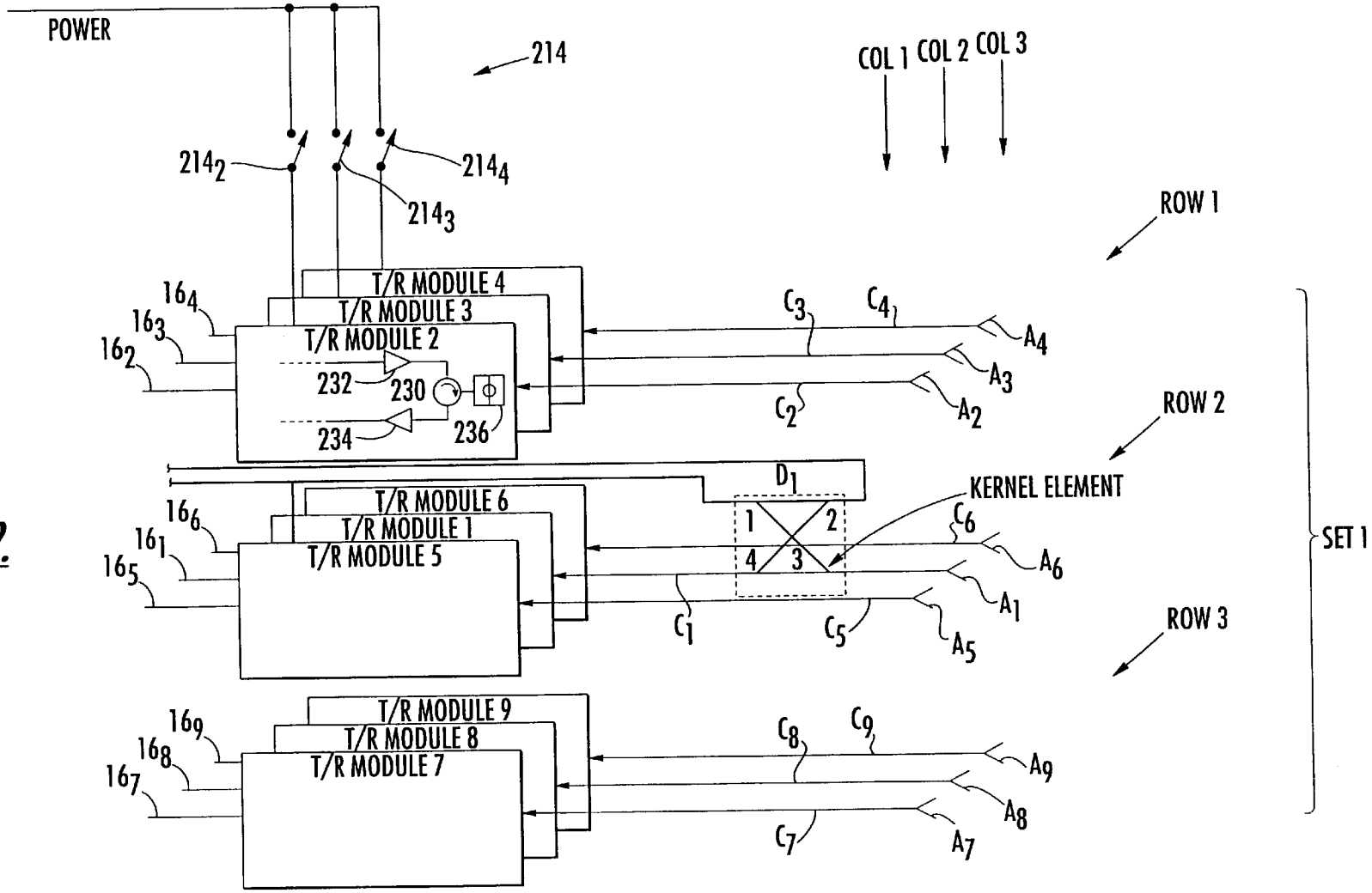
FIG. 2 illustrates one possible three-dimensional arrangement of elemental antennas lying in an array plane.

FIG. 2 is a representation of one possible arrangement of nine elemental antennas of one set of elemental antennas. In FIG. 2, elements corresponding to those of FIG. 1 are designated by like reference numerals. In FIG. 2, the nine elemental antennas of set 1 are arranged in a subarray of three rows and three columns. As illustrated, kernel antenna element $A_1$ is located at the center of the subarray, in column 2, row 2. The other antenna elements, namely antenna elements $A_2$ through $A_9$, are arranged around element $A_1$. More specifically, antenna element $A_2$ lies in column 1, row 1, antenna element $A_3$ lies in column 2, row 1, antenna element $A_4$ lies in column 3, row 1, antenna element $A_5$ lies in column 1, row 2, antenna element $A_6$ lies in column 3, row 2, antenna element $A_7$ lies in column 1, row 3, antenna element $A_8$ lies in column 2, row 3, and antenna element $A_9$ lies in column 3, row 3. The locations of the elemental antennas within the array or subarray may affect the amplitude or phase correction applied by the beamformer (not separately illustrated) to the signals transduced by the particular elements, as for example a tapered amplitude distribution may be required in the horizontal plane (a plane parallel to the plane in which any row lies) or in the vertical plane (a plane parallel to the plane in which any column lies), or in both planes, in order to reduce or ameliorate the effects of antenna sidelobes. As can be seen, each of the non-kernel elemental antennas of FIG. 2 is adjacent its corresponding kernel elemental antenna.

In FIG. 2, some of the active devices associated with a TR module are illustrated. TR module $TR_2$ is taken as illustrative of the kinds of devices which are found in all of the modules. In module $TR_2$, a forward or power amplifier 232 receives signals to be transmitted from a source (not illustrated) and provides amplified signal to an input port of a circulator 230. Circulator 230 circulates the amplified signal to be transmitted to the next port in the direction of circulation indicated by the arrow. The signal to be transmitted exits from circulator 230, and proceeds by way of a phase shifter (ϕ) 236 and coupling path $C_2$ to elemental antenna $A_2$, from which the signal is radiated. When elemental antenna $A_2$ receives signal, the received signal is applied to a port of circulator 230, and is circulated in the direction of circulation indicated by the arrow to a further port, where the signal exits the circulator and arrives at the input port of a low-noise or receiver amplifier 234. The received signal amplified by amplifier 234 is made available to other portions (not illustrated) of the system.

In FIG. 2, a TR module powering arrangement is designated generally as 210. As illustrated, module powering arrangement 210 includes a power source conductor 212, and a switch connected between the power source conductor 212 and each TR module $TR_1$ through $TR_9$ (not all modules are illustrated as being connected to a switch). In the arrangement of FIG. 2, a switch $\mathbf{214}_2$ of a set 214 of switches is illustrated as controlling the energizing power applied to TR module $TR_2$, switch $\mathbf{214}_3$ controls the power applied to TR module $TR_3$, and switch $\mathbf{214}_4$ controls the power applied to TR module $TR_4$. Corresponding switches (not illustrated) control the power applied to the other modules of FIG. 2. It should be noted that the switches of set 214 are illustrated by mechanical switch symbols, which those skilled in the art will interpret as being generic switches, which may be of the solid-state, remotely controlled type. In contemplated applications, the switches of set 214 will be electronic switches remotely controllable by a computer, and will be switched according to calibration and other algorithms. It should also be noted that the term "between" as used in electrical systems has a meaning different from that used in ordinary parlance. In particular, the word "between" means electrical coupling to the two named elements, regardless of the path taken by the coupling, which may or may not physically lie between the named elements. Thus, the power or energization to each TR module and its associated active elements may be individually and independently controlled from a remote location.

In FIG. 1, each directional coupler $D_1, D_2, \ldots D_L$ has four ports, designated 1, 2, 3, and 4. Directional couplers are well known in the art, and their salient features for purposes of the present invention are that signal applied to port 1 exits from ports 2 and 3, but not from port 4, and signal applied to port 2 exits from ports 1 and 4, but not from port 3. In FIGS. 1 and 2, port 1 of directional coupler $D_1$ is coupled to a directional coupler calibration port $D_1$, by way of a path $D_{1,1}L$, port 2 of directional coupler $D_1$ is coupled to a directional coupler calibration port $D_{1,2}$ by way of a path $D_{1,2}L$, port 3 of directional coupler $D_1$ is coupled to the feed port of elemental antenna $A_1$and port 4 of directional coupler $D_1$ is coupled to output port $TR_1o$ of TR module $TR_1$. In FIG. 1, other corresponding directional couplers are similarly connected to other directional coupler calibration ports. More particularly, port 1 of directional coupler $D_2$ is coupled to a directional coupler calibration port $D_{2,1}$ by way of a path $D_{2,1}L$, port 2 of directional coupler $D_2$ is coupled to a directional coupler calibration port $D_{2,2}$ by way of a path $D_{2,2}$ L, port 3 of directional coupler $D_2$ is coupled to the feed port of elemental antenna $A_{10}$ and port 4 of directional coupler $D_2$ is coupled to output port $TR_{10}o$ of TR module $TR_{10}$, and port 1 of directional coupler $D_L$ is coupled to a directional coupler calibration port $D_{L,1}$ by way of a path $D_{L,1}L$, port 2 of directional coupler $D_L$ is coupled to a directional coupler calibration port $D_{L,2}$ by way of a path $D_{L,2}L$, port 3 of directional coupler $D_L$ is coupled to the feed port of elemental antenna $A_{N-8}$, and port 4 of directional coupler $D_L$ is coupled to output port $TR_{N-8}o$ of TR module $TR_{N-8}$. These connections, together with electrical switches coupled to the various TR modules to enable them to be separately or independently energized and deenergized, make it possible to separately calibrate the various paths through the beamformer, and thereby control, or compensate for, differences in the performances of the active elements. More particularly, the amplitude transfer function or gain of the amplifiers can be determined, and either corrected to a nominal value, or compensated for in the signal processing on the feed side of the array antenna.

The array antenna as so far described can be calibrated according to another aspect of the invention. In order to calibrate the array antenna, it is necessary to individually determine the characteristics of each functional active device. For example, it will be necessary to determine the gain or input-output amplitude transfer function of each amplifier, including the transmit or forward-direction amplifier and the receive or return-direction amplifier. If there are any elements, including amplifiers, which change or drift in phase as a function of time or environmental conditions, the phase value should be known. If there are other active elements in the transmission path extending between the input or beam ports 12 of the beamformer and the elemental antennas, then their amplitude andor phase transfer functions must also be determined.

In essence, the presence of the directional couplers in at least some of the paths extending between the beamformer and the elemental antennas allows the characteristics of the paths through the beamformer to be determined. In general, the calibration paths are first themselves calibrated as to amplitude andor phase, and this information is used, together with amplitude andor phase information determined from transmission through the calibration paths and the beamformer paths, with only the one active element or TR module under test energized. In a preferred embodiment, the various amplifiers or active devices are of a type in which the port impedances do not change a great deal with amplifier energization, so that impedance effects when the amplifiers are deenergized do not perturb the measurements. Such amplifiers are well known.

Figure 3:
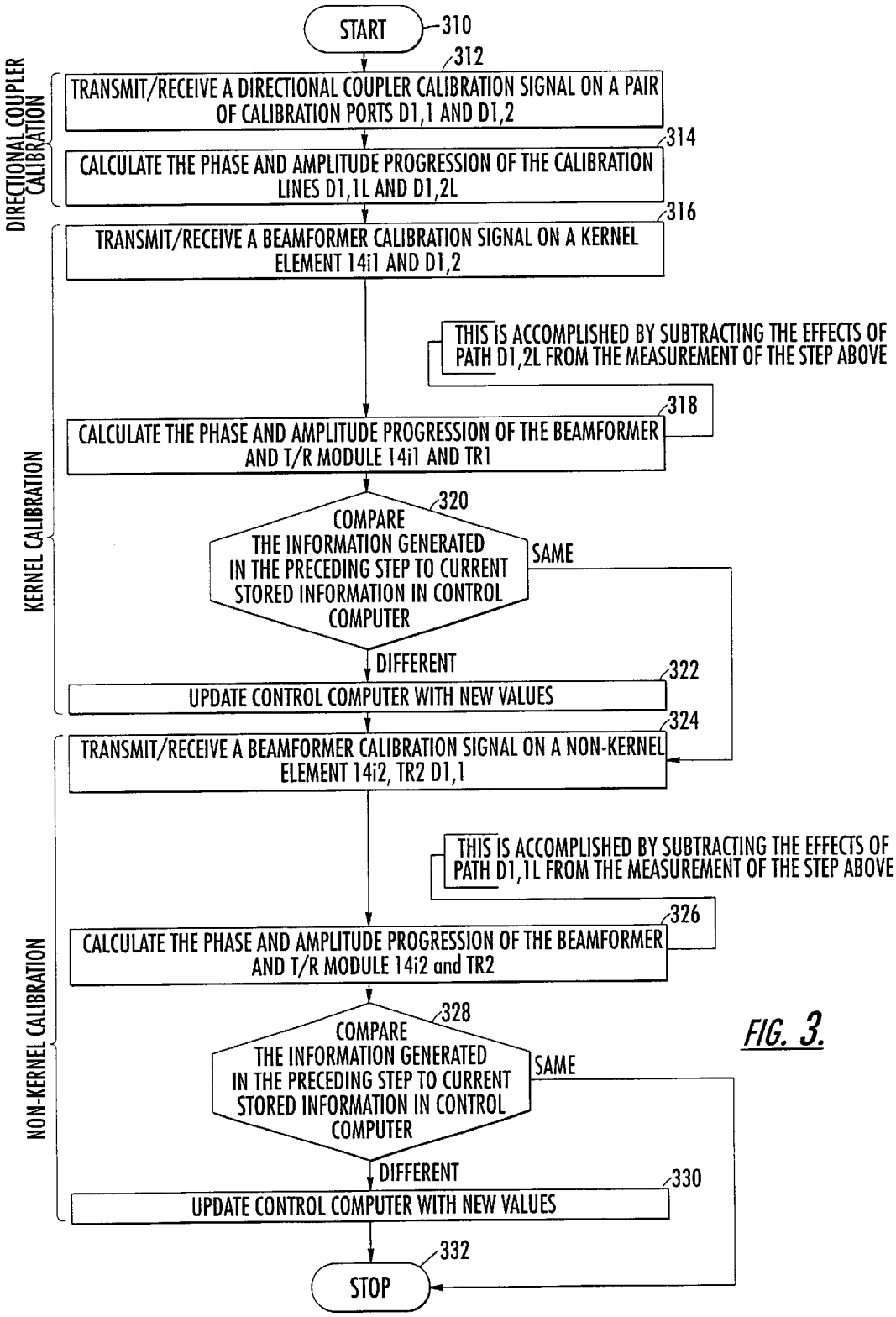
FIG. 3 is a simplified flow chart or diagram illustrating the logic for performing the calibration according to an aspect of the invention.

According to a further aspect of the invention, the array antenna is calibrated by the method set forth in FIG. 3. In FIG. 3, the calibration logic begins at a START block 310, and proceeds to a block 312. Block 312 represents the transmission of a directional coupler calibration signal on one of a pair of directional coupler calibration ports, such as port $D_{1,1}$ of the set including ports $D_{1,1}$ and $D_{1,2}$ of FIG. 1, and receiving the directional coupler calibration signal on the other one of the pair of ports. From block 312 of FIG. 3, the logic flows to a logic block 314, which represents the comparison of the received directional coupler calibration signal with the transmitted directional coupler calibration signal, to thereby determine the phase and amplitude characteristics or progression attributable to the calibration lines $D_{1,1}L$ and $D_{1,2}L$ of FIG. 1. This calculation inherently includes the step of accessing a memory which defines the amplitude and phase characteristics of the path between ports 1 and 2 of directional coupler $D_1$. If the directional couplers of the system are sufficiently identical, this may require only the storage of common values for the characteristics, but the memory requirements are not excessive even if individual information must be stored for each directional coupler.

From block 314, the logic of FIG. 3 flows to a block 316. Block 316 represents turning off all of the TR modules except that one (TR1) associated with the kernel array element $A_1$, and applying a beamformer calibration signal through the path extending between a beamformer port such as $\mathbf{14}i_1$ and a calibration port such as $D_{1,2}$ of FIG. 1. The direction in which the signal is propagated will depend upon whether the particular kernel element is adapted for transmission, reception, or both. If transmission only is expected, then the TR module associated with the kernel element will have only a transmit or "power" amplifier such as 230 of FIG. 2, and transmission of the beamformer calibration signal is from a beamformer port $\mathbf{14}i_x$ (where x represents any subscript) of FIG. 1 to port $D_{1,2}$. On the other hand, if there is only a receive amplifier such as amplifier 234 of FIG. 2, then the transmission of the beamformer calibration signal is from calibration port $D_{1,2}$ to beamformer port $\mathbf{14}i_x$. If the array is intended for both transmission and reception, then the TR module associated with each antenna element, and in particular with the kernel element under consideration, will have both transmit and receive amplifiers, and the test must be performed in both directions (assuming, of course, that both directions of propagation are to be calibrated). From block 316 of FIG. 3, the logic flows to a block 318, which represents calculation of the amplitude and phase characteristics of the beamformer and TR module $TR_1$. Assuming that the electrical path lengths of transmission lines $D_{1,1}L$ and $D_{1,2}L$ are set the same, as by fabrication to the same physical length (or to dissimilar physical lengths but trimmed for identical electrical lengths), the electrical length of transmission path $D_{1,2}$ is known to be $\frac{1}{2}(D_{1,1}+D_{1,2}-L_{1,2})$, where $L_{1,2}$ is the electrical length through directional coupler $D_1$ from port 1 to port 2. Again, the calculation step represented by block 318 requires accessing a memory in which the electrical characteristics are stored of the path between ports 2 and 4 of directional coupler $D_1$.

From block 318 of FIG. 3, the logic flows to a decision block 320, which compares the information relating to the characteristics of the beamformer path as determined in blocks 312 to 318 with the previous values. If the values are the same, within certain limits, then the logic leaves decision block 320 by the SAME path and flows to a block 324. If the information is different, the logic leaves decision block 320 by the DIFFERENT path, and arrives at a block 322. Block 322 represents the updating of the control computer with new calibration values for the path between selected beamformer port $\mathbf{14}i_x$ and the beamformer output port $TR_1o$. The steps represented by blocks 312 through 322 may be repeated for each one of the kernel elements of the array antenna 10 of FIG. 1 (three such kernel elements illustrated).

From either block 320 or 322 of FIG. 3, the logic arrives at a block 324, which represents transmission and reception of calibration signals associated with a nonkernel element of FIG. 1. Block 324 includes the step of energizing the TR module associated with the selected one of the non-kernel elements, such as kernel element $A_2$, associated with output port $TR_2o$ of beamformer 14. For this particular nonkernel element, the TR module is $TR_2$. With $TR_2$ energized or activated and all the other TR modules inactive, calibration signal is transmitted between a directional coupler calibration port such as $D_{1,1}$ and a beamformer "input" port $\mathbf{14}_x$ for the antenna beam under consideration. Assuming transmission from beamformer port $\mathbf{14}i_1$ to calibration port $D_{1,1}$, the path is through the corporate feed 14 and through TR module $TR_2$ to path $C_2$, then near-field coupling or mutual coupling from antenna element $A_2$ to antenna element $A_1$, from port 3 to port 1 of directional coupler $D_1$, and thence to calibration port $D_{1,1}$. Transmission in the opposite direction merely traverses the same paths in retrograde order. From block 324, the logic of FIG. 3 flows to a block 326. Block 326 represents calculation of information about the amplitude and phase of the path extending between beamformer "input" port $\mathbf{12}_x$ and "output" port $TR_2o$. This information is determined by simply subtracting from the value determined in step 324 the information relating to directional coupler $D_1$ and transmission path $D_{1,1}L$ of FIG. 1. Inherent in the calculations associated with block 326 of FIG. 3 is the need to also subtract information relating to (a) the lengths of transmission line between the output ports of the beamformer and the associated elemental antennas, and (b) the mutual coupling between the nonkernel elemental antenna and the associated kernel antenna. These values are also stored in memory. To the extent that environmental effects may affect the mutual coupling, these must be compensated for, or the environmental effects removed. Such an effect might include the presence of a large body adjacent the antenna structure, or moisture coating the elemental antennas and ground plane of the array. Some of the necessary information may be of the type which can be stored in memory, and other information may not be amenable to storage. The effects of moisture are believed to be capable of storage, while the effects of a large object might not be, unless its parameters could be defined, in which case the only solution might be removal of the object.

From block 326 of FIG. 3, the logic flows to a decision block 328, which determines if the new information about the coupling within the beamformer is the same as that currently stored or not. If the information is the same within a particular tolerance, the logic leaves the decision block by the SAME output, and proceeds to STOP block 332. If the information is different, the new value updates the currently stored value in block 330, again with the proviso that confirmatory measurements might be desired before updating takes place. Naturally, the steps represented by blocks 322 through 330 may be performed for each of the nonkernel elements and the associated one of the kernel elements, to thereby calibrate the beamformer paths associated with each of the antenna elements.

While the description assumes that each nonkernel antenna element is associated with one, and only one, of the kernel elements, it may be desirable to perform the measurement of each nonkernel element with more than one kernel element, so as to reduce the chance of anomalous results. For each of plural measurements associated with one nonkernel element with various kernel elements, the results can be averaged, or, if they are within a given tolerance, the results of any one of the measurements may be stored for use.

Other embodiments of the invention will be apparent to those skilled in the art. For example, while the phase shifter in FIG. 2 is illustrated as being located at the "output" of the circulator, those skilled in the art will know that two phase shifters may be instead used in, or with, the other two ports of the circulator. While it has been assumed that any beamformer port could be used to aid in calibrating any portion of the beamformer, it should be understood that a particular beamformer port may not be internally connected to particular one or ones of the beamformer output ports, in which case those output ports cannot of course be calibrated from the nonconnected input ports. While the logic has been shown as exiting decision block 320 of FIG. 3 by the DIFFERENT output if the results do not match the stored information, those skilled in the art know that it may be desirable to repeat the measurement and to make a "permanent" change of the recorded information only if the retest confirms the initial test.

Thus, an aspect of the invention lies in a method for calibrating the active elements of an array antenna used for transducing electromagnetic signal between unguided radiation and a guided transmission path. The active array antenna (10) includes a beamformer (12) including at least one guided-wave common port (a port of set 12*i*, such as port $\mathbf{14}i_2$) and at least N output ports (set 14*o*) associated with the common port ($\mathbf{14}i_2$). The guided-wave common port ($\mathbf{14}i_2$) may be considered to be the "feed" port for one beam of the array antenna (10). The array antenna (10) also includes a beamformer (12) control computer (20) coupled to the beamformer (12), for transducing signals therewith, and for forming antenna beams based upon at least one of beamformer (12) amplitude and phase transfer functions, and preferably both. The array antenna (10) also includes a plurality of N radiating elements ($A_1$ through $A_N$) arranged in an array (FIG. 2). Each of the radiating elements ($A_1$ through $A_N$) is capable of transducing electromagnetic signals with its own elemental port (as for example $A_1p$). A plurality of 2P calibration ports ($D_1$,1 through $D_L$,2) is provided, where P may be less than N in a preferred embodiment. P directional couplers ($D_1$, $D_2$, . . . , $D_L$) are provided. Each of the P directional couplers ($D_1$, $D_2$, . . . , $D_L$) includes first (1), second (2), third (3), and fourth (4) ports, for coupling signal from the first port (1) to the second (2) and third (3) ports and not to the fourth (4) port, and from the second port (2) to the first (1) and fourth (4) ports, but not to the third port (3). Each of the P directional couplers ($D_1$, $D_2$, . . . , $D_L$) has its first port (1) coupled to one, and only one, of the calibration ports ($D_1$,1 through $D_L$,2), its second port (2) coupled another to one, and only that one, of the calibration ports ($D_1$,1 through $D_L$,2), its third port (3) connected to a "kernel" one ($A_1$, $A_{10}$, . . . $A_{N-8}$), and only that kernel one, of the N radiating elements ($A_1$ through $A_N$), and its fourth port (4) coupled to one, and only one, of the N output ports ($TR_1o$, $TR_2o$, . . . , $TR_No$) of the beamformer (12). As a result of these connections of P directional couplers ($D_1$, $D_2$, . . . , $D_L$) to 2P calibration ports ($D_1$,1 through $D_L$,2) and P output ports out of N available output ports ($TR_1o$, $TR_2o$, . . . , $TR_No$) of the beamformer (12), N−P=R non-kernel ones of the radiating elements lack a guided path to a directional coupler, and R ports of the beamformer (12) are not connected to one of the directional couplers ($D_1$, $D_2$, . . , $D_L$). The array antenna (10) further includes a guided-wave connection between each of the R ports of the beamformer (12) which are not connected to one of the directional couplers ($D_1$, $D_2$, . . . , $D_L$) and a corresponding one of the R non-kernel radiating elements, as a result of which all of the N elemental antennas ($A_1$ through $A_N$) are connected to an output port ($TR_1o$, $TR_2o$, . . . , $TR_No$) of the beamformer (12), either through a directional coupler ($D_1$, $D_2$, . . . , $D_L$) or through another guided-wave connection ($C_2$–$C_9$, $C_{11}$, $C_{N-7}$, $C_N$). At least one of (a) an active amplifier (230, 232) and (b) a controllable phase shifter (236) is associated with at least some of the paths defined between the guided-wave common port ($\mathbf{14}i_2$) and the at least N output ports ($TR_1o$, $TR_2o$, . . . , $TR_No$) associated with the common port ($\mathbf{14}i_2$) of the beamformer (12).

According to another aspect of the invention, a method for calibrating the array antenna (10) includes the step (312) of applying a directional coupler calibration signal to a first one of the calibration ports ($D_1$, $D_1$,1 through $D_L$,2), for thereby transmitting signal to a first port of a first one of the directional couplers ($D_1$, $D_2$, . . . , $D_L$), and in response to the step of applying of a directional coupler calibration signal, receiving returned directional coupler calibration signal at a calibration port coupled to the second port of the first one of the directional couplers ($D_1$, $D_2$, . . . , $D_L$) The amplitude and the phase of the returned directional coupler calibration signal are compared (314) with the corresponding amplitude and phase of the calibration signal to establish a calibration transfer value for the guided-wave connection between the first one of the directional couplers ($D_1$, $D_2$, . . . , $D_L$) and its associated calibration ports ($D_1$, $D_1$,1 through $D_L$,2). The calibration transfer value may be also adjusted (314) by comparison with a known or memorized value (if it's known or predetermined, it must be stored somewhere, and is therefore memorized) of the transfer characteristics of the directional coupler itself. This allows the effects of the directional coupler to be separated from the effects of the guided-wave connections or transmission lines. Thus, at least one of the amplitude and phase, and preferably both, of the calibration transfer value is compared with a predetermined value, to thereby establish a directional coupler calibration reference value for the first one of the directional couplers ($D_1$, $D_2$, . . . , $D_L$). The next step (316) in the calibration is to (a) apply beamformer (12) calibration signal to the common port (14$i_2$) of the beamformer (12) and extract corresponding beamformer (12) calibration signal from that calibration port coupled to the second port of the first one of the directional couplers ($D_1$, $D_2$,. . . , $D_L$), or (b) apply beamformer (12) calibration signal to that one of the calibration ports ($D_1$, $D_1$,1 through $D_L$,2) coupled to the second port of the first one of the directional couplers ($D_1$, $D_2$, . . . , $D_L$), and extract corresponding beamformer (12) calibration signal from the beamformer (12) common port (14$i_2$), to thereby determine (318) at least one of the amplitude and phase transfer between the common port (14$i_2$) of the beamformer (12) and the fourth port of the first one of the directional couplers ($D_1$, $D_2$, . . . , $D_L$). As set forth in the claims, the terminology "one of A and B" differs slightly from "either A or B" but has the same meaning, as understood by persons skilled in the art. From the calibration transfer value and from at least one of the amplitude and phase transfer between the common port (14$i_2$) of the beamformer (12) and the fourth port of the first one of the directional couplers ($D_1$, $D_2$, . . . , $D_L$), at least one of the amplitude and phase characteristics of that signal path extending from the common port (14$i_2$) of the beamformer (12) to the fourth port of the first one of the directional couplers ($D_1$, $D_2$, . . . , $D_L$) are determined (318). The beamsteering control computer (20) is adjusted by updating (320, 322) the parameters by which the control takes place, if necessary, which may mean updating the value of the one of the amplitude and phase characteristic (or both) of that signal path extending from the common port (14$i_2$) of the beamformer (12) to the fourth port of the first one of the directional couplers ($D_1$, $D_2$, . . . , $D_L$)

In a specific embodiment of an array antenna (10) according to an aspect of the invention, the transmission-line electrical lengths (of physical connections $D_{1,1}$L and others) extending between the calibration ports ($D_1$, $D_1$,1 through $D_L$,2) and the first (1) and second (2) ports of any one of the directional couplers ($D_1$, $D_2$, . . . , $D_L$) are made or set equal, whereby the calibration transfer value for each of the cables is equal to one-half the calibration transfer value of the guided-wave connection to the one of the directional couplers ($D_1$, $D_2$, . . . , $D_L$).

A specific mode of the method according to the invention includes the further step of deenergizing (in block 324 by means of power control 214) all active elements of the beamformer (12) except for those active elements lying in that path through the beamformer (12) extending from the common port (14$i_2$) of the beamformer (12) to a particular non-kernel one of the radiating elements of the array. This specific mode also includes the step (324) of one of (a) applying beamformer (12) calibration signal to the common port (14$i_2$) of the beamformer (12) and extracting corresponding beamformer (12) calibration signal from that one of the calibration ports ($D_1$, $D_1$,1 through $D_L$,2) associated with the first port of the first one of the directional couplers ($D_1$, $D_2$, . . . , $D_L$) and (b) applying beamformer (12) calibration signal to that one of the calibration ports ($D_1$, $D_1$,1 through $D_L$,2) associated with the first port of the first one of the directional couplers ($D_1$, $D_2$, . . . , $D_L$) and extracting corresponding beamformer (12) calibration signal from the common port (14$i_2$) of the beamformer (12), to thereby calculate or produce (326) a nonkernel calibration signal including a measure of the mutual coupling between that one of the kernel radiating elements associated with the first one of the directional couplers ($D_1$, $D_2$, . . . , $D_L$) and the particular non-kernel one of the radiating elements of the array. Finally, this specific mode includes the step (328, 330) of adjusting the beamsteering control computer (20) by updating the parameters by which the control takes place by a factor responsive to the nonkernel calibration signal.

What is claimed is:

1. A method for calibrating the active elements of an array antenna, said array antenna being for transducing electromagnetic signal between unguided radiation and a guided transmission path, and including:

a beamformer including at least one guided-wave common port and at least N output ports associated with said common port;

a beamformer control computer coupled to said beamformer, for transducing signals therewith, and for forming beams based upon at least one of beamformer (a) amplitude and (b) phase transfer functions;

a plurality of N radiating elements arranged in an array, each of which radiating elements is capable of transducing electromagnetic signals with its own elemental port;

a plurality of 2P calibration ports, where P is less than N;

P directional couplers, each of said couplers including first, second, third, and fourth ports, for coupling signal from said first port to said second and third ports and not to said fourth port, and from said second port to said first and fourth ports, but not to said third port, each of said P directional couplers having its first port coupled to one, and only one, of said calibration ports, its second port coupled to another one, and only that one, of said calibration ports, its third port connected to a kernel one, and only said kernel one, of said N radiating elements, and its fourth port coupled to one, and only one, of said N output ports of said beamformer, whereby N−P=R non-kernel ones of said radiating elements lack a guided path to a directional coupler, and R ports of said beamformer are not connected to one of said directional couplers;

a guided-wave connection between each of said R ports of said beamformer which are not connected to one of said directional couplers and a corresponding one of said R non-kernel radiating elements; and at least one of (a) an active amplifier and (b) a controllable phase shifter associated with at least some of the paths defined between said guided-wave common port and said at least N output ports associated with said common port of said beamformer; said method comprising the steps of:

applying a directional coupler calibration signal to a first one of said calibration ports, for thereby transmitting signal to a first port of a first one of said directional couplers;

in response to said step of applying of a directional coupler calibration signal, receiving returned directional coupler calibration signal at a calibration port coupled to the second port of said first one of said directional couplers;

comparing the amplitude and the phase of said returned directional coupler calibration signal with the corresponding amplitude and phase of said calibration signal to establish a calibration transfer value for said guided-wave connection between said first one of said directional couplers and its associated calibration ports;

one of (a) applying beamformer calibration signal to said common port of said beamformer and extracting corresponding beamformer calibration signal from that calibration port coupled to said second port of said first one of said directional couplers and (b) applying beamformer calibration signal to that one of said calibration ports coupled to said second port of said first one of said directional couplers, and extracting corresponding beamformer calibration signal from said beamformer common port, to thereby determine at least one of said amplitude and phase transfer between said common port of said beamformer and said fourth port of said first one of said directional couplers;

from said calibration transfer value and from at least one of said one of said amplitude and phase transfer between said common port of said beamformer and said fourth port of said first one of said directional couplers, determining at least one of the amplitude and phase characteristics of that signal path extending from said common port of said beamformer to said fourth port of said first one of said directional couplers; and adjusting said beamsteering control computer by updating the parameters by which said control takes place by updating the value of said one of said amplitude and phase characteristic of that signal path extending from said common port of said beamformer to said fourth port of said first one of said directional couplers.

2. A method according to claim 1, further comprising the step of:

setting the electrical lengths of said cables between said calibration ports and said first and second ports of any one of said directional couplers equal, whereby said calibration transfer value for each of said cables is equal to one-half the calibration transfer value of said guided-wave connection to said one of said directional couplers.

3. A method according to claim 1, further comprising the step of:

de-energizing all active elements of said beamformer except for those active elements lying in that path through said beamformer extending from said common port of said beamformer to a particular non-kernel one of said radiating elements of said array;

one of (a) applying beamformer calibration signal to said common port of said beamformer and extracting corresponding beamformer calibration signal from that one of said calibration ports associated with said first port of said first one of said directional couplers and (b) applying beamformer calibration signal to that one of said calibration ports associated with said first port of said first one of said directional couplers and extracting corresponding beamformer calibration signal from said common port of said beamformer, to thereby produce a nonkernel calibration signal including a measure of the mutual coupling between that one of said kernel radiating elements associated with said first one of said directional couplers and said particular non-kernel one of said radiating elements of said array; and adjusting said beamsteering control computer by updating the parameters by which said control takes place by a factor responsive to nonkernel calibration signal.

4. A method according to claim 1, further comprising, between said step of comparing the amplitude and the phase of said returned directional coupler calibration signal with the corresponding amplitude and phase of said calibration signal and said step of one of (a) applying beamformer calibration signal to said common port of said beamformer and (b) applying beamformer calibration signal to that one of said calibration ports, the further step of:

comparing said calibration transfer value with a predetermined value, to thereby establish a directional coupler calibration reference value for said first one of said directional couplers.

* * * * *